United States Patent [19]

Conn

[11] 4,119,245

[45] Oct. 10, 1978

[54] CAP-LESS CONTAINER AND/OR DISPENSER

[76] Inventor: John L. Conn, P.O. Box 4501-Sta. B, Spartanburg, S.C. 29303

[21] Appl. No.: 773,678

[22] Filed: Mar. 2, 1977

[51] Int. Cl.[2] ..... A47G 19/12

[52] U.S. Cl. ..... 222/465; 220/94 A

[58] Field of Search ..... 220/4 E, 94 A, 94 B, 220/94 R; 222/475, 129, 465, 468, 562, 475; 248/317, 340, 359; 403/348, 349; 215/100 A

[56] References Cited

U.S. PATENT DOCUMENTS

| | | | |
|---|---|---|---|
| 3,619,852 | 11/1971 | Eckberg | 220/94 R |
| 3,831,805 | 8/1974 | Yonce | 220/94 A |

*Primary Examiner*—Joseph F. Peters, Jr.
*Assistant Examiner*—Norman L. Stack, Jr.

[57] ABSTRACT

A container and a removable cover is provided with a flow control spout effected through alignable openings in the cover and the container and the cover and container are respectively provided with integral handle elements assembled when the cover is attached to the container.

1 Claim, 4 Drawing Figures

CAP-LESS CONTAINER AND/OR DISPENSER

This invention relates to the common home food canning container.

A principle object of the present invention is to provide a pair of containers that when filled with contents will self seal or screw connect the two said containers together as one sealed container and handle assembly.

Another object of the present invention is to provide a method of thus connecting or sealing of two containers wherein the common use of lids and caps are no longer needed since the one container serves to seal or connect the other.

Another object of the present invention is to provide home food canning containers that can be re-used year after year.

In the modified design of the present invention; a principle object of the present invention is to provide a container that will dispense its liquid contents by gravity wherein the container is not lifted as is commonly done to pour out its contents, said container is thus a container and dispenser assembly, all in one.

These and other objects will be readily evident upon a study of the following specifications and the accompanying drawings wherein:

FIG. 2 is a view of one of the other connecting containers with the other one-half handle and nozzle assembly. (FIG. 1 will thus screw connect to FIG. 2.)

Figure 4:
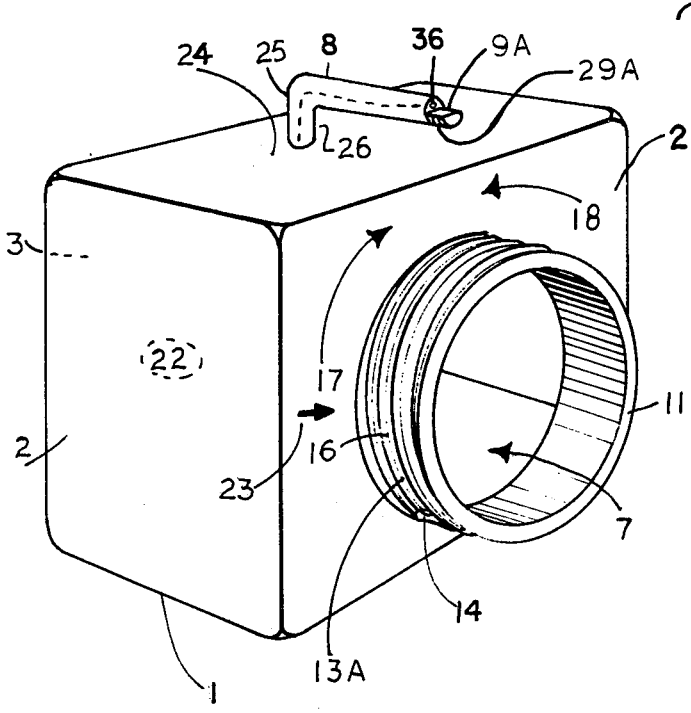
FIG. 4 is a view of the basic modified container and dispenser.
Figure 3:
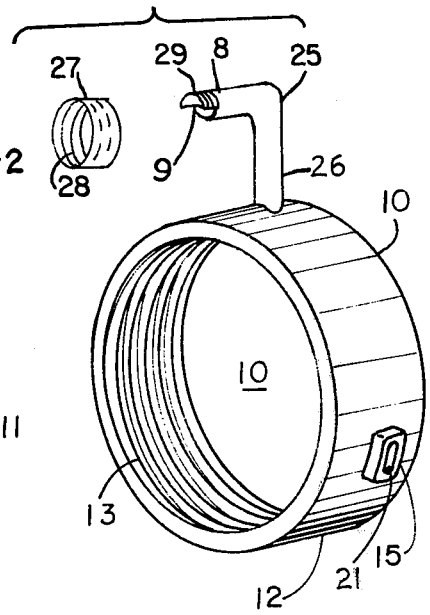
FIG. 3 is a view of a modified design of the container and/or dispenser lid or cover assembly, which serves to cover said container and also serves to dispense said contents.

Note: This basic invention consists of FIGS. 1 and 2, wherein FIGS. 3 and 4 are modified designs thereof.

Figure 1:
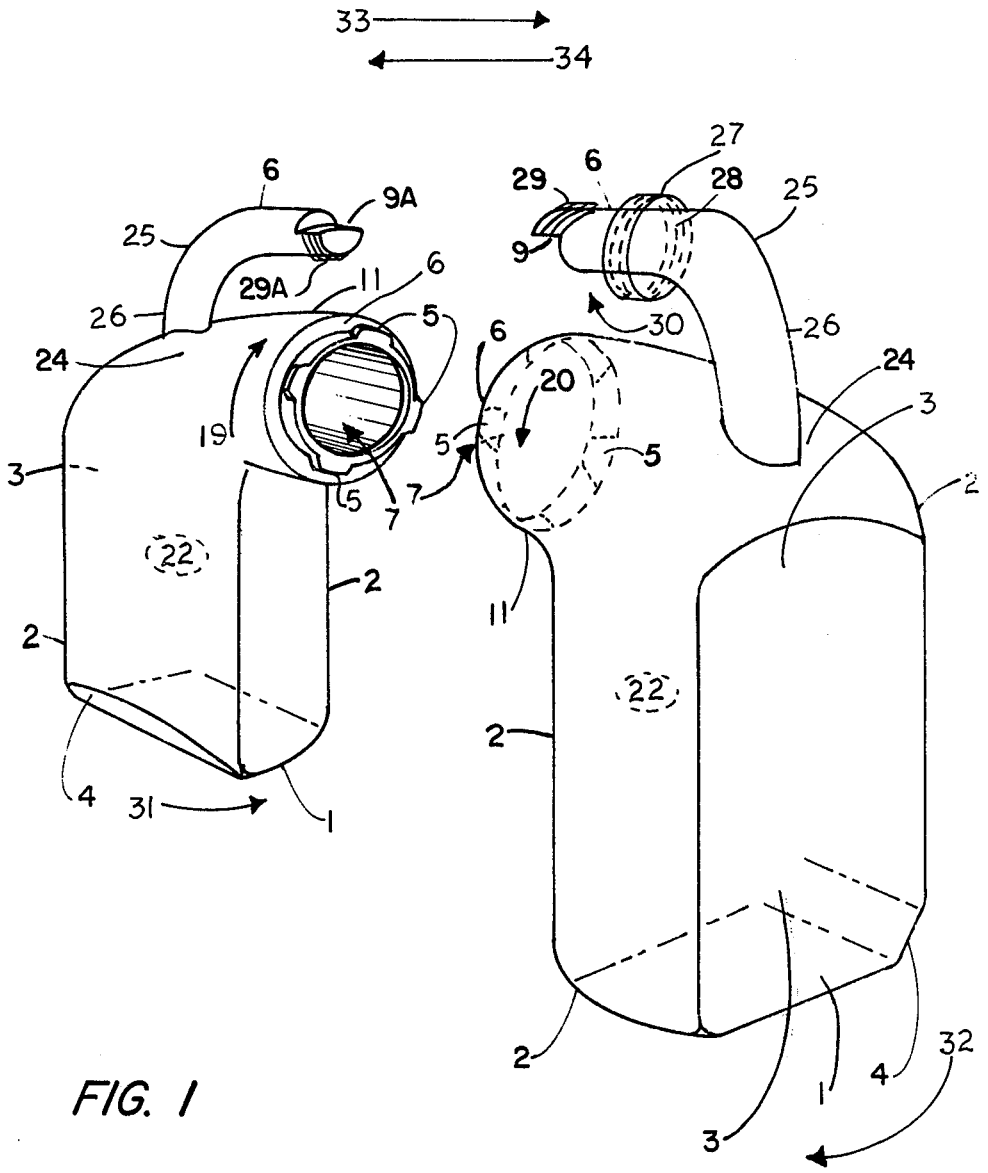
FIG. 1 is a view of one of the connecting containers with the one-half handle and nozzle assembly.

Referring now to the drawings in detail, and more particularly to FIGS. 1 and 2 thereof at this time, the reference numeral FIG. 1 and FIG. 2 represent two separate containers that can be filled at the container's opening 7 with contents 22 wherein the one container (FIG. 1) will screw connect 5 and 6 to the other container FIG. 2 as the common bayonet type 5 and 6 connection. The two screw connecting containers (FIG. 1 and FIG. 2) are formed or constructed from plastic so as to construct the one-half container in the one assembly wherein the container has a flat bottom area 1 wherein this bottom flat area 1 has an angled flat side bottom end area 4 with a flat back base container wall 3 wherein the remainder of the base container walls 2 are rounded so as to construct the container with a smaller cylindrical 90° turn so to construct a nozzle spout end 11 wherein the top container area 24 has the one-half built into handle 26 that curves to 90° 25 and extends inward to, and above the nozzle end 11 wherein this handle 8 has a one-half split end 9 ad 9A threaded area 29 and 29A so to secure said completed handle 8 by screw connecting the free sliding screw ring 27 with the threaded ring area 28 to the handle one-half ends 29 and 29A as per arrow 30.

When it is desired to fill and connect these two containers (FIG. 1 and FIG. 2) as the one connected or sealed units; both units are placed so to rest the two units on the flat container's back side area 3 and then the contents 22 are poured into the nozzle end 11 at the opening area 7, when the two containers are filled almost full they are then made to rest on the container's bottom area 1 wherein the one container (FIG. 1) is taken and secured by the operator's left hand at the one-half handle area 8 and tilted to rest on area 4 as per arrow 31 and 34 wherein the other container (FIG. 2) is taken and secured by the operator's right hand at the one-half handle area 8 and tilted to rest on area 4 as per arrow 32 and 33 wherein these two containers are brought together and screw connected 5 and 6 as per arrow 19 to connect the two units as one assembly wherein the two connected containers (FIG. 1 and FIG. 2) will the rest on the flat bottom area (1) wherein the two one-half handles 8 are screw connected by joining the handle end areas 9 and 9A and 29 and 29A by the handle free sliding screw clamp (27) by the screw connecting areas 28 to areas 29 and 29A so to complete the assembly.

To unseal said containers, the procedure is thus reversed as per arrow 20.

Now to discuss the Modified Designs as per FIG. 3 and FIG. 4 wherein this modified design is related to the common milk or liquid plastic container where this container (FIG. 3 and FIG. 4) serves as a container and dispenser.

In this modified design the basic container FIG. 4 is square in design with a flat bottom 1 and flat sides 2 and flat back 3 and flat top 24 wherein the flat front side 2 has an extended cylindrical exterior threaded 13A nozzle 11 that contains an open side nozzle hole 14 and a center nozzle opening 7 so to serve as a threaded 13A nozzle 11 opening area 7 wherein a container cover (FIG. 3) will screw connect at the cover threaded area 13 to the container's threaded area 13A as per arrow 17.

The container and/or dispenser (FIG. 3 and FIG. 4) is constructed with the one-half handle as described previously in the basic invention as was defined in FIG. 1 and FIG. 2.

The container and/or dispenser cover (FIG. 3) is constructed with a cylindrical side cover 12 opening 21 and spout area 15 with the enclosed cover end 10 wherein this (FIG. 3) has the internal threaded area 13 so to connect to the base container (FIG. 4) and seal the unit. This cover (FIG. 3) will serve as the container cover when connected as per arrow 17 and will also serve as a dispenser when the cover arm 8 is turned as per arrow 18 so as to line the cover spout 15 and hole 21 with that of the base container (FIG. 4) at the side nozzle hole 14 wherein the arrow area 23 will line with the handle end 29 of the cover so to gravity pour out its liquid contents 22. To turn off the flow of the liquid contents 22 the handle 8 of the cover (FIG. 3) is thus reversed as per arrow 17. When the container is closed the spout area 15 and 21 of the cover will rest at the container's threaded area 13A at area 16 so as not to pour out. Container handle contain the intake air hole 36.

The handle of this design will also operate as was previously discussed as per FIG. 1 and FIG. 2.

While various changes may be made in the design of this invention, it is understood that such design changes will not change the spirit and scope of the present invention as is defined by the claims.

What is claimed:

1. The combination of a container and removable closure wherein said container comprises a hollow vessel and having a lower transverse side opening, including closure connecting means surrounding said opening said closure having coacting means for being removably mounted on said colsure connecting means in further combination with handles on both container and closure adapted to join when said closure is mounted on said container to form an integral transverse handle, said closure having coacting means for being removably mounted on said colsure connecting means wherein said closure is ring shaped having a closure wall spaced from and opposite an opening including a curvate side wall with a spout, and connecting means includes an operture which aligns with the spout when the closure is in specific position mounted on said coacting means, said closure being movable to a second position in which the spout is sealed.

* * * * *